United States Patent [19]

Jaakonmäki et al.

[11] Patent Number: 4,493,352

[45] Date of Patent: Jan. 15, 1985

[54] WOOD CHIP SHAVER

[75] Inventors: Matti Jaakonmäki; Pentti Raura, both of Valko, Finland

[73] Assignee: Rauma-Repola Oy, Finland

[21] Appl. No.: 456,744

[22] Filed: Jan. 10, 1983

[30] Foreign Application Priority Data

Jan. 12, 1982 [FI] Finland ..... 820097

[51] Int. Cl.[3] ..... B27C 1/00

[52] U.S. Cl. ..... 144/162 R; 144/2 R; 241/95; 241/275

[58] Field of Search ..... 144/162 R, 163, 176, 144/2 R; 241/47, 48, 95, 135, 136, 146, 151, 275, 292.1

[56] References Cited

U.S. PATENT DOCUMENTS

| | | | |
|---|---|---|---|
| 3,738,596 | 6/1973 | Miles | 241/95 |
| 3,807,644 | 4/1974 | Van Ee | 241/95 |
| 3,823,880 | 7/1974 | Urschel | 241/95 |

*Primary Examiner*—W. D. Bray

[57] ABSTRACT

A wood chip shaver, consisting of cutting blades disposed on a circle and of a rotor rotating about its drive shaft therewithin and carrying a chip guide means. The drive shaft is vertical and the rotor carries a plurality of chip guide plates on top of each other. By the aid of the invention, each blade will be evenly loaded and do shaving over its whole length.

3 Claims, 2 Drawing Figures

WOOD CHIP SHAVER

The present invention concerns a wood chip shaver consisting of cutting blades disposed on a circle and of a rotor rotating about its drive shaft therewithin, said rotor carrying a chip guide means.

In shavers of prior art, the axis of the blade circle and that of the rotor are horizontal. For this reason, the chips are supplied to the blade circle from the side, whereby most of the chips end up in the lower part of the blade circle. Normal-sized chips are shaved on the length of about one-half revolution, and the blade circle is therefore one-sidedly loaded. This gives rise to bending forces acting on the rotor, to uneven wearing of the blade circle and blades and to underload of the blade circle doing the shaving. With a view to the shaving capacity of the machine, the consumption of electric energy, uniform blunting of the blades and uniform wearing of the abrasion surfaces, the even distribution of chips over the entire blade circle of the shaver is of primary importance.

The object of the present invention is to produce a rotor of a novel type, in which the blades are loaded evenly and over their whole length. The shaver of the invention is characterized in that the drive shaft is vertical and that the rotor carries a plurality of chip guide plates on top of each other. Since the drive shaft is vertical, the incoming chips are evenly distributed on the circumference of the rotor by action of centrifugal force. Since there are several guide plates, the chips are distributed in different layers in the chip guiding members. Hereby is achieved that each blade does the same amount of shaving, uniformly on its whole length. Thus, the blade also wears out uniformly.

An advantageous embodiment of the invention is characterized in that the chip guide plates, the lowermost plate excepted, have apertures in their centre, in the manner that the apertures constitute a downwardly tapering stepped cone. Hereby, the incoming chips are evenly distributed to the chip guide plates and further to the blades.

Another embodiment of the invention is characterized in that the chip guide plates are downwardly widening cones. Hereby, the incoming chips are directed towards the blades.

Figure 1:
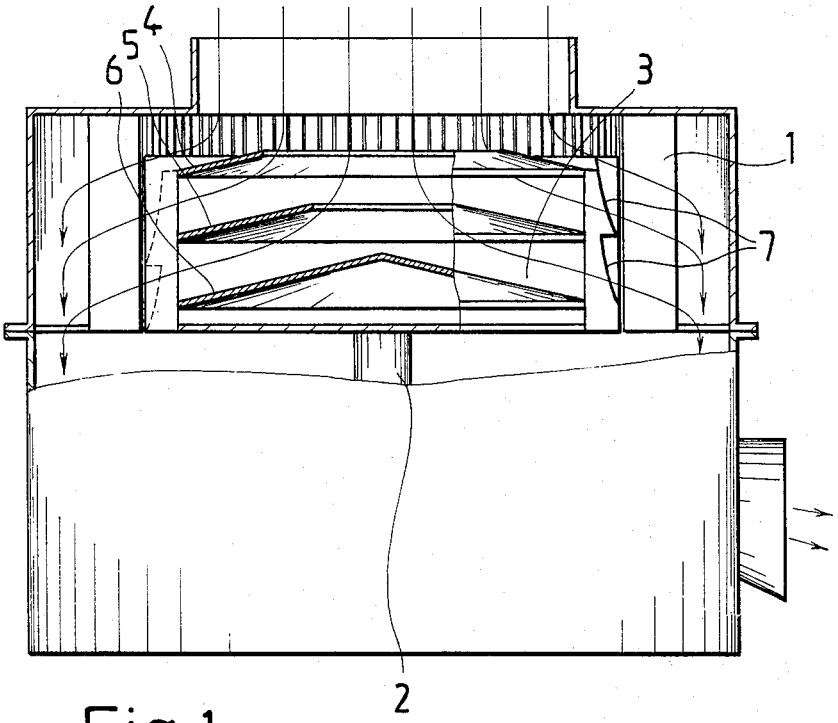

The invention is described in the following by the aid of an example with reference being made to the drawing attached, wherein FIG. 1 presents a shaver according to the invention, partly sectioned.

Figure 2:
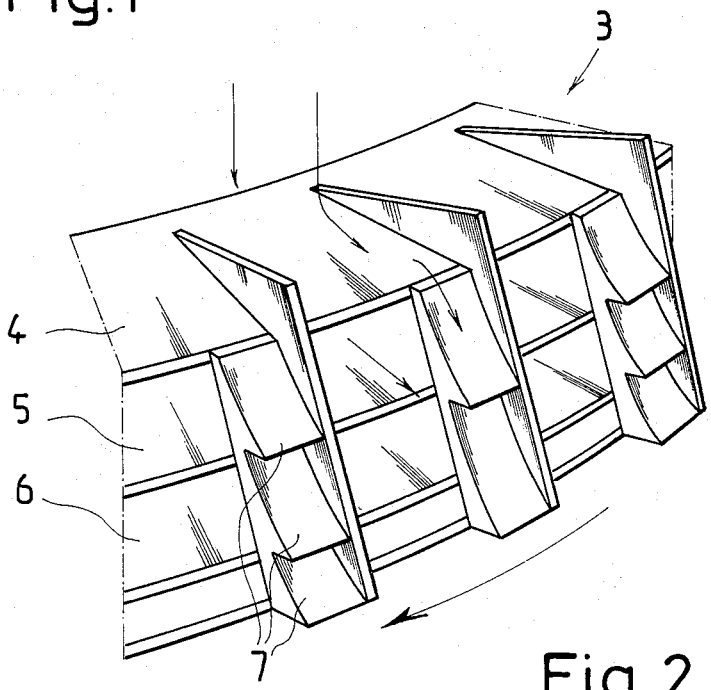

FIG. 2 shows part of the rotor.

The shaver is composed of cutting blades 1 disposed on a circle and of a rotor 3 rotating about its drive shaft 2 therewithin and carrying chip guide plates 4, 5, 6. The drive shaft 2 is vertical and the rotor 3 carries three chip guide plates 4, 5, 6 on top of each other. The chip guide plates 4, 5 have an aperture in their centre so as to create a downwardly tapering stepped cone.

The chips entering the shaver are evenly distributed in the manner shown by arrows, between the guide members 7 and the blades 1 and directed toward the blades where they are cut into shavings by the blades, whereby each blade will be evenly loaded and will shave on its whole length.

It is obvious to a person skilled in the art that various embodiments of the invention may vary within the scope of the claims stated below.

We claim:

1. Wood chip shaver comprising a rotor, a vertical drive shaft for said rotor, said rotor being rotatable about said drive shaft, cutting blades disposed on a circle around the outside of said rotor, chip guide means carried by said rotor, and a plurality of chip guide plates carried by said rotor, said chip guide plates being disposed on top of each other.

2. Shaver according to claim 1, wherein the chip guide plates, with the exception of the lowermost plate, have in their centre apertures formed so that the apertures constitute a downwardly tapering stepped cone.

3. Shaver according to claim 1, wherein the chip guide plates are downwardly widening cones.

* * * * *